US006086489A

United States Patent [19]

Hsu

[11] Patent Number: 6,086,489

[45] Date of Patent: Jul. 11, 2000

[54] SHOCK ABSORBING END CAP MOUNTED TO A RACKET HANDLE

[76] Inventor: Young-Chen Hsu, No. 121, Section 1, Shen Lin Rd., Taya Hsiang, Taichung Hsien, Taiwan

[21] Appl. No.: 09/295,697

[22] Filed: Apr. 21, 1999

[51] Int. Cl.[7] ..... A63B 49/08

[52] U.S. Cl. ..... 473/549; 473/300

[58] Field of Search ..... 473/549, 551, 473/298, 300

[56] References Cited

U.S. PATENT DOCUMENTS

| | | | |
|---|---|---|---|
| 3,360,264 | 12/1967 | Lamkin et al. | 473/549 X |
| 3,366,384 | 1/1968 | Lamkin et al. | 473/549 X |
| 4,195,837 | 4/1980 | Poulin | 473/298 |
| 4,907,810 | 3/1990 | Whiteford | 473/523 |
| 5,000,452 | 3/1991 | Kuebler | 473/549 |
| 5,069,452 | 12/1991 | Chen | 473/549 |
| 5,485,996 | 1/1996 | Niksich | 473/549 |
| 5,642,882 | 7/1997 | Guerzini | 473/549 |
| 5,690,566 | 11/1997 | Bracho | 473/549 |

FOREIGN PATENT DOCUMENTS

| | | | |
|---|---|---|---|
| 323770 | 1/1930 | United Kingdom | 473/FOR 183 |

*Primary Examiner*—Raleigh W. Chiu
*Attorney, Agent, or Firm*—Rosenberg, Klein & Lee

[57] ABSTRACT

An end cap for a racket handle includes a tubular member mounted to the racket handle, a collar member connected to the rear end of the tubular member and a board retained in the collar member. A plurality of recesses are respectively defined in the inside and the outside of the tubular member and the inside of the tubular member snugly contacts the racket handle. The collar member has an annular wall extending transversely therefrom and the annular wall snugly contacts the tubular member. The recesses are sealed by the racket handle and the annular wall so as to be defined as chambers which absorb shocks transferred from the racket.

8 Claims, 5 Drawing Sheets

SHOCK ABSORBING END CAP MOUNTED TO A RACKET HANDLE

FIELD OF THE INVENTION

The present invention relates to an end cap mounted to the rear end of the handle of a tennis racket, and more particularly, to an end cap having chambers defined in the outside and/or inside thereof so as to absorb shocks transferred from the racket.

BACKGROUND OF THE INVENTION

As illustrated in FIG. 1, when holding the handle 4 of a tennis racket, the inside of the portion between the hand and the wrist of the player contacts the conventional end cap 3 mounted to the rear end of the handle 4. The severe shocks due to the impact when a ball hitting the racket will be resisted by the hand so as to reduce the shaking of the racket. Referring to FIGS. 2 and 3, the end cap 3 is tapered in its outside and mounted to the rear end of the handle 4. A flange 31 extends inwardly from the inside of the end cap 3 and a groove 32 defined in the inside of the end cap 3. A board comprising a body 5 and an engaging plate 51 is engaged with the groove 32. The end cap 3 generally is made of solid material and performs no function and the tapered outside of the end cap 3 is convenient for the hand of the player to contact. When a shock is transferred from the racket, the hand will stop the shaking by the contact of the end cap 3 and the hand. Nevertheless, the player feel uncomfortable because the shock is so severe and the player feel pain on his/her hand holding the handle 4.

The present invention intends to provide an end cap having chambers defined in the outside and/or inside thereof so that the end cap is deformable and absorbs shocks transferred from the racket. The end cap of the present invention effectively resolves the shortcomings found in the conventional end cap of a tennis racket.

SUMMARY OF THE INVENTION

In accordance with one aspect of the present invention, an end cap for a racket handle is provided and comprises a tubular member having the first end thereof mounted to the racket handle. A plurality of recesses defined in the inside thereof and the inside of the tubular member snugly contacts the racket handle.

A collar member has an annular wall extending transversely therefrom relative to a plane passing through the collar member. The collar member is mounted to the tubular member with the annular wall snugly contacting the tubular member. A board is retained in the collar member.

The primary object of the present invention is to provide an end cap for a racket handle wherein the end cap has chambers defined in the outside and inside thereof so as to absorb shocks from the racket.

Further objects, advantages, and features of the present invention will become apparent from the following detailed description with appropriate reference to the accompanying drawings.

DETAILED DESCRIPTION OF THE PREFERRED EMBODIMENTS

Figure 1:
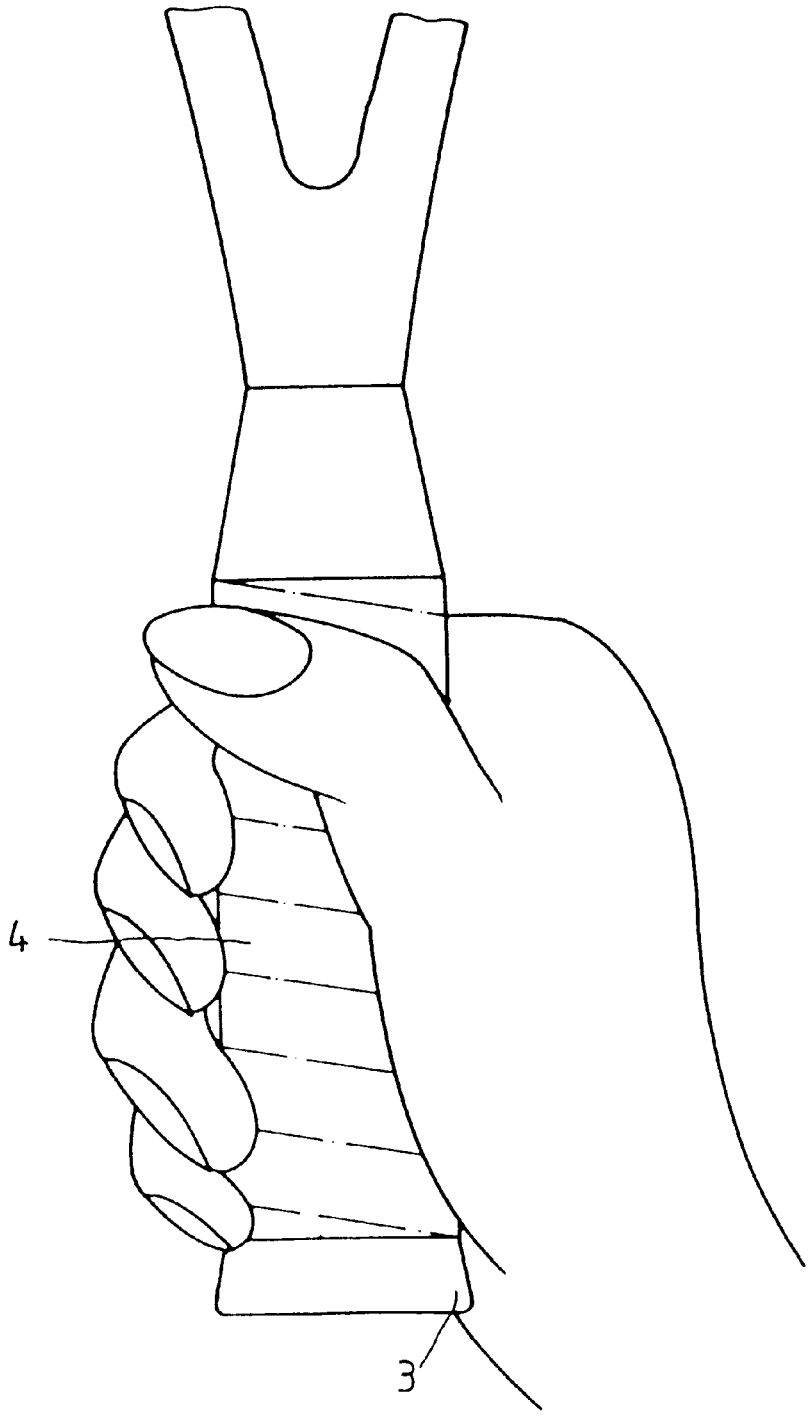
FIG. 1 PRIOR ART
FIG. 1 is an illustrative view to illustrate a player's hand holding the handle of a racket with the inside of the hand contacting the conventional end cap.
Figure 2:
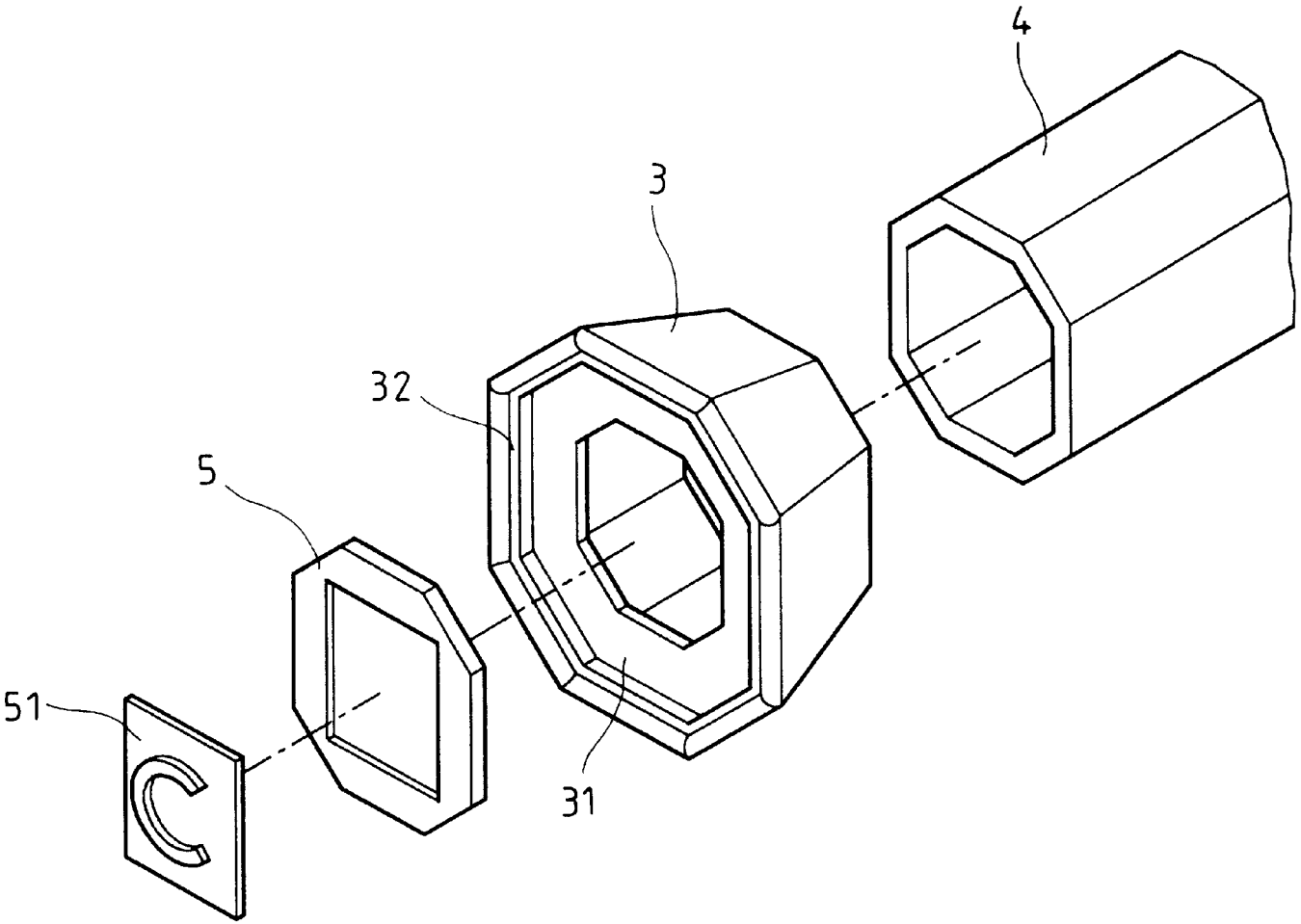
FIG.2 PRIOR ART
FIG. 2 is an exploded view of the conventional end cap.
Figure 3:
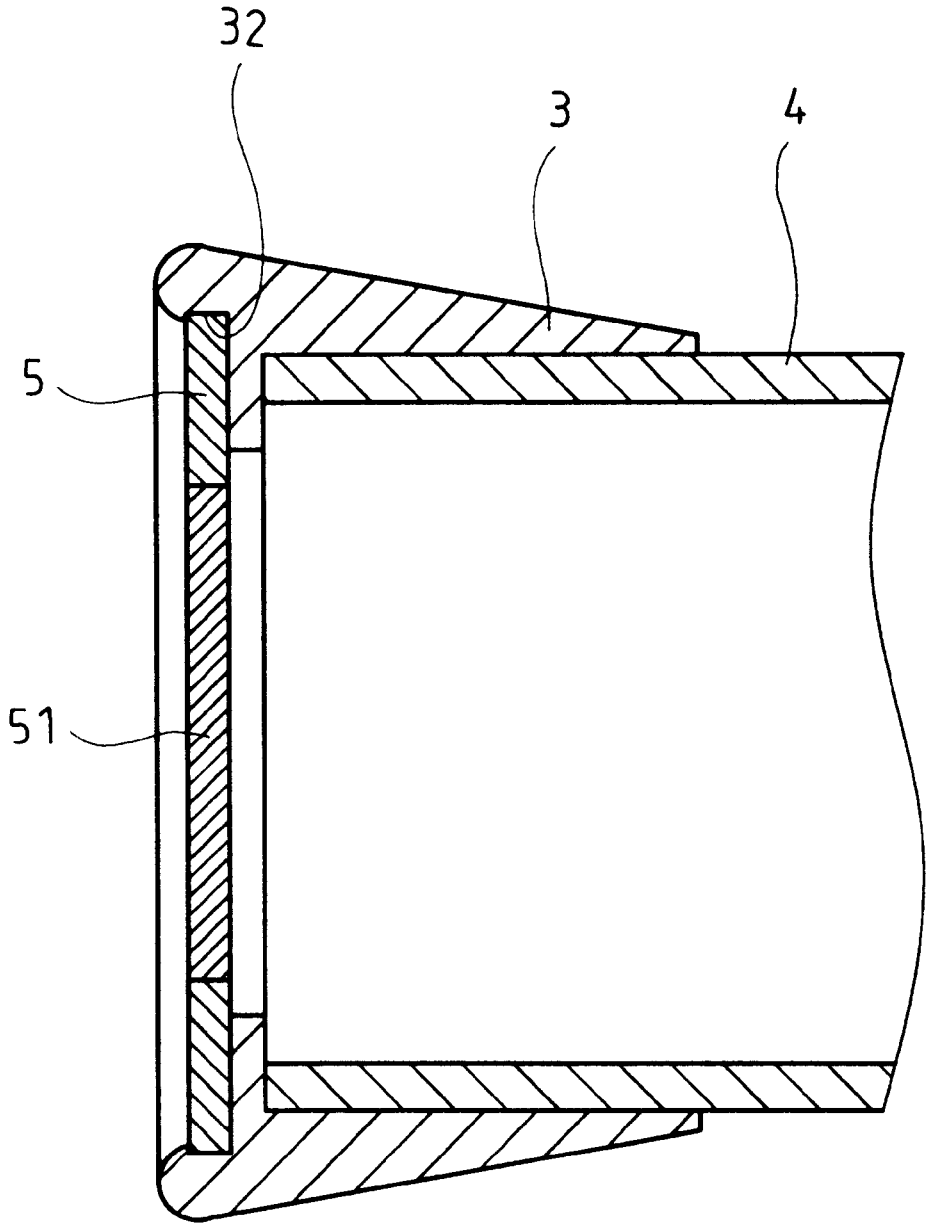
FIG.3 PRIOR ART
FIG. 3 is a side elevational view, partly in section, of the conventional end cap mounted to the handle of the racket.
Figure 4:
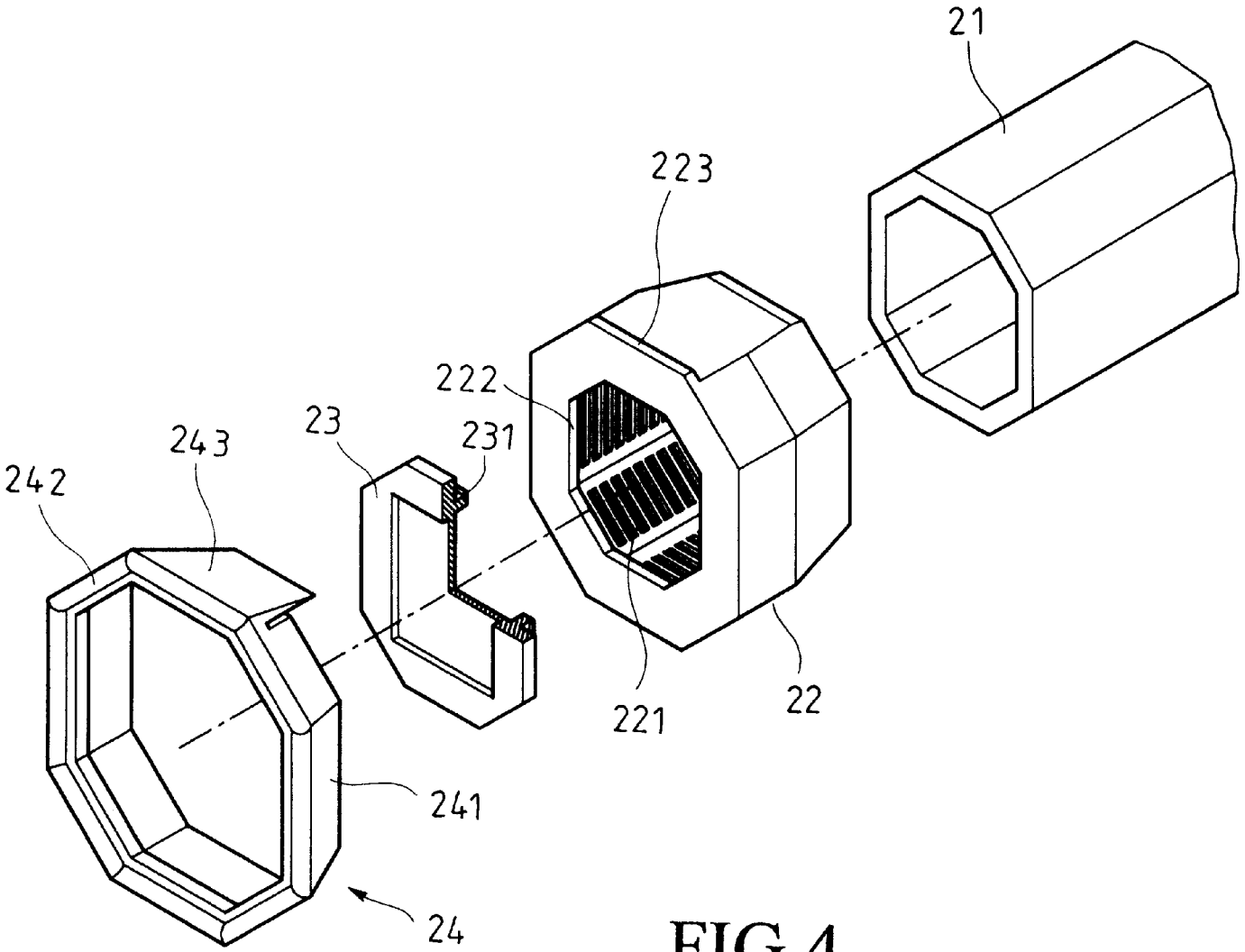
FIG. 4 is an exploded view of the end cap in accordance with the present invention.
Figure 5:
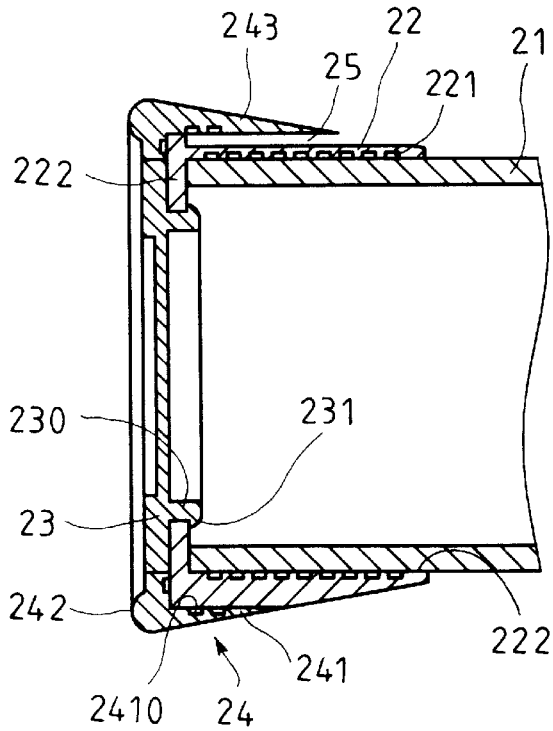
FIG. 5 is a side elevational view, partly in section, of the first embodiment of the end cap in accordance with the present invention mounted to the handle of the racket.

Referring to FIGS. 4 and 5, the end cap in accordance with the present invention comprises a tubular member 22 having the first end thereof mounted to the racket handle 21 and a flange 222 extends radially inward from the second end of the tubular member 22. The flange 222 contacts the distal end of the racket handle 21. A plurality of first recesses 221 are defined in the inside of the tubular member 22 and the inside of the tubular member 22 snugly contacts the outside of the racket handle 21 so as to form chambers between the tubular member 22 and the handle 21. The second end of the tubular member 22 has a rib 223 extending radially outward therefrom.

A collar member has an annular wall 241 extending transversely therefrom relative to a plane passing through the collar member 24. The collar member 24 is mounted to the tubular member 22 with the annular wall 241 snugly contacting the tubular member 22. A gap 25 is defined between the annular wall 241 of the collar member 24 and the outside of the tubular member 22. The portion of the annular wall 241 corresponding to the rib 223 is in a form of a long plate 243 so that when wrapping a grip band (not shown) around the handle 21, one of the two ends of the grip band is received in the gap 25. The collar member 24 further has an annular rounded ridge portion 242 extending radially outward therefrom so that the player's hand feel comfortable when contacting the annular rounded ridge portion 242. The annular wall 241 of the collar member 24 has a plurality of third recesses 2410 defined in the inside thereof so that chambers are defined between the outside of the tubular member 22 and the inside of the annular wall 241 of the collar member 24.

A board 23 is retained in the collar member 24. The board 23 has an annular flange 230 extending from one of two sides thereof and the annular flange 230 has a hook portion 231 formed thereto. The annular flange 230 is inserted into the second end of the tubular member 22 and the hook portion 231 is engaged with the inside of the flange 222 of the tubular member 22.

When shocks are transferred from the racket, the air retained in the chambers is compressed so as to absorb the shocks and the shaking of the racket will be quickly reduced.

Figure 6:
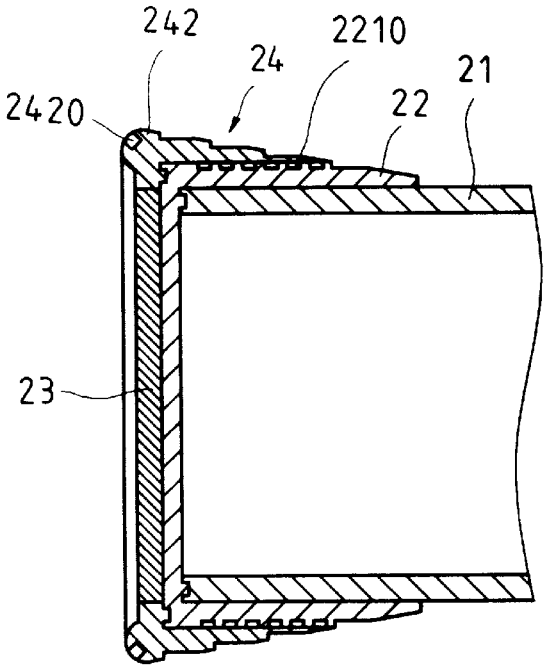
FIG. 6 is a side elevational view, partly in section, of the second embodiment of the end cap in accordance with the present invention mounted to the handle of the racket.

FIG. 6 shows the second embodiment of the present invention wherein the tubular member 22 has a plurality of second recesses 2210 defined in the outside thereof so as to define chambers between the annular wall 241 of the collar member 24 and the tubular member 22. The annular rounded ridge portion 242 has at least one notch 2420 defined in the outside thereof. Therefore, the end cap provides a better shock absorbing feature.

The invention is not limited to the above embodiment but various modification thereof may be made. It will be understood by those skilled in the art that various changes in form and detail may made without departing from the scope and spirit of the present invention.

What is claimed is:

1. An end cap for a racket handle, comprising:

a tubular member having the first end thereof adapted to be mounted to the racket handle, a plurality of first recesses defined in the inside thereof and the inside of said tubular member adapted to snugly contact the racket handle;

a collar member having an annular wall extending transversely therefrom relative to a plane passing through said collar member, said collar member mounted to said tubular member with said annular wall snugly contacting said tubular member, and a board retained in said collar member.

2. The end cap as claimed in claim 1, wherein said end cap has a flange extending radially inward from the second end thereof and said flange is adapted to contact the distal end of the racket handle.

3. The end cap as claimed in claim 1, wherein said board has an annular flange extending from one of two sides thereof and said annular flange has a hook portion formed thereto, said annular flange inserted into the second end of said tubular member and said hook portion engaged with the inside of said flange of said tubular member.

4. The end cap as claimed in claim 1, wherein said tubular member has a plurality of second recesses defined in the outside thereof.

5. The end cap as claimed in claim 1, wherein the second end of said tubular member has a rib extending radially outward therefrom so as to define a gap between said annular wall of said collar member and the outside of said tubular member.

6. The end cap as claimed in claim 1, wherein said collar member has an annular rounded ridge portion extending radially outward therefrom.

7. The end cap as claimed in claim 6, wherein said annular rounded ridge portion has at least one notch defined in the outside thereof.

8. The end cap as claimed in claim 1, wherein said annular wall of said collar member has a plurality of third recesses defined in the inside thereof.

* * * * *